US008635998B2

(12) United States Patent
Madan et al.

(10) Patent No.: US 8,635,998 B2
(45) Date of Patent: Jan. 28, 2014

(54) TUNABLE FLAMELESS HEATERS

(75) Inventors: Deepak Madan, Blue Bell, PA (US); John E. McConaghie, Brick, NJ (US); Richard S. Varga, Welland (CA); Rajiv Tandon, Princeton, NJ (US)

(73) Assignee: Read Manufacturing Company, Manchester, NJ (US)

( * ) Notice: Subject to any disclaimer, the term of this patent is extended or adjusted under 35 U.S.C. 154(b) by 730 days.

(21) Appl. No.: 12/802,170

(22) Filed: Jun. 1, 2010

(65) Prior Publication Data

US 2010/0300426 A1 Dec. 2, 2010

Related U.S. Application Data

(60) Provisional application No. 61/217,577, filed on Jun. 2, 2009.

(51) Int. Cl.

| | |
|---|---|
| ***A61F 7/00*** | (2006.01) |
| ***A61F 7/02*** | (2006.01) |
| ***A61F 7/03*** | (2006.01) |
| ***C09K 5/18*** | (2006.01) |

(52) U.S. Cl.

USPC ..... 126/263.07; 607/96; 607/104; 607/107; 607/108; 607/114; 126/263.01; 126/263.02; 126/263.08; 44/250; 602/2

(58) Field of Classification Search

USPC ..... 126/263.01–263.1; 607/96, 104, 607/107–111, 114; 44/250; 165/46; 252/70; 602/2

See application file for complete search history.

(56) References Cited

U.S. PATENT DOCUMENTS

| | | | |
|---|---|---|---|
| 2,431,220 | A | 11/1947 | Evans et al. |
| 3,175,558 | A | 3/1965 | Caillouette et al. |

(Continued)

FOREIGN PATENT DOCUMENTS

| | | |
|---|---|---|
| GB | 753684 | 7/1956 |
| WO | WO 2009/006521 A2 | 1/2009 |

*Primary Examiner* — Linda Dvorak
*Assistant Examiner* — Kaitlyn Smith
(74) *Attorney, Agent, or Firm* — Rod D. Baker

(57) ABSTRACT

A flameless heater apparatus and method whose heating capacity and performance can be selected and tuned at the time of manufacture, and which is easily used and has a long shelf life. The apparatus and method may be used in flameless ration heaters, such as may be used in military or emergency situations. There is provided a flameless heating method and apparatus in which the solid reactive ingredients (not including liquid reactant, typically water) are not all blended or mixed together at the time of apparatus fabrication. Rather, at least one key ingredient (typically a super-corroding alloy of magnesium and iron) in a dry powder form is kept physically segregated from all the other ingredients, such as catalysts (normally acids such as acetic or tartaric acid or acidic mixtures) and surfactants. The exothermic chemical reaction is initiated only after at least one (typically a dry powder catalyst) goes into aqueous solution after the application of water (saline or non-saline). The catalytic solution flows out, through, and about and among water-permeable pockets in the pouch-like apparatus which contain one or more other ingredients, including the active ingredient (e.g., the Mg—Fe alloy). Thus, the catalyst and the active ingredient do not come into effective contact until a flowing aqueous saline solution carries a reactive catalytic-saline solution to the active ingredient alloy, and then mixes the inter-reactive ingredients to generate the desired heat.

78 Claims, 9 Drawing Sheets

(56) References Cited

U.S. PATENT DOCUMENTS

| | | | | | |
|---|---|---|---|---|---|
| 3,550,578 | A | | 12/1970 | Fearon et al. | |
| 3,804,077 | A | * | 4/1974 | Williams | 126/263.1 |
| 3,951,127 | A | * | 4/1976 | Watson et al. | 126/206 |
| 4,106,478 | A | * | 8/1978 | Higashijima | 149/15 |
| 4,205,957 | A | * | 6/1980 | Fujiwara | 44/250 |
| 4,366,804 | A | * | 1/1983 | Abe | 126/263.02 |
| 4,462,224 | A | * | 7/1984 | Dunshee et al. | 62/530 |
| 4,522,190 | A | | 6/1985 | Kuhn et al. | |
| 4,649,895 | A | * | 3/1987 | Yasuki et al. | 126/263.05 |
| 4,780,117 | A | * | 10/1988 | Lahey et al. | 62/4 |
| 4,856,651 | A | * | 8/1989 | Francis, Jr. | 206/219 |
| 4,894,931 | A | * | 1/1990 | Senee et al. | 36/2.6 |
| 5,089,233 | A | | 2/1992 | DeVaney et al. | |
| 5,117,809 | A | | 6/1992 | Scaringe et al. | |
| 5,355,869 | A | | 10/1994 | Pickard et al. | |
| 5,366,492 | A | * | 11/1994 | Ueki | 607/114 |
| 5,465,707 | A | * | 11/1995 | Fulcher et al. | 126/263.08 |
| 5,517,981 | A | | 5/1996 | Taub et al. | |
| 5,611,329 | A | | 3/1997 | Lamensdorf | |
| 5,736,110 | A | | 4/1998 | Angelillo et al. | |
| 5,984,953 | A | | 11/1999 | Sabin et al. | |
| 6,116,231 | A | | 9/2000 | Sabin et al. | |
| 6,248,257 | B1 | | 6/2001 | Bell et al. | |
| 6,289,889 | B1 | | 9/2001 | Bell et al. | |
| 6,309,598 | B1 | | 10/2001 | Tully | |
| 6,341,602 | B1 | | 1/2002 | Fulcher | |
| 6,393,843 | B2 | * | 5/2002 | Kohout | 62/4 |
| 6,484,514 | B1 | | 11/2002 | Joseph et al. | |
| 6,524,331 | B1 | | 2/2003 | Kohout et al. | |
| 6,564,558 | B1 | | 5/2003 | Seymour | |
| 6,640,801 | B2 | | 11/2003 | Sabin et al. | |
| 6,648,909 | B2 | | 11/2003 | Helming | |
| 6,726,386 | B1 | * | 4/2004 | Gruenbacher et al. | 401/7 |
| 6,766,797 | B1 | | 7/2004 | Lavigne et al. | |
| 6,827,080 | B2 | | 12/2004 | Fish et al. | |
| 6,920,873 | B2 | | 7/2005 | Venkatesan et al. | |
| 7,008,656 | B2 | | 3/2006 | Zimmerman, Jr. et al. | |
| 7,021,064 | B2 | | 4/2006 | Wohland et al. | |
| 7,021,848 | B1 | | 4/2006 | Gruenbacher et al. | |
| 7,243,788 | B2 | | 7/2007 | Schmidt et al. | |
| 7,258,117 | B2 | | 8/2007 | Payen et al. | |
| 8,205,608 | B2 | * | 6/2012 | Bommaraju | 126/263.06 |
| 2004/0065315 | A1 | * | 4/2004 | Fish et al. | 126/263.08 |
| 2005/0224388 | A1 | | 10/2005 | Saric et al. | |
| 2006/0005827 | A1 | | 1/2006 | Consoli et al. | |
| 2006/0153955 | A1 | | 7/2006 | Hickey | |
| 2007/0256677 | A1 | | 11/2007 | Yim et al. | |
| 2008/0083725 | A1 | | 4/2008 | Stease et al. | |
| 2008/0135040 | A1 | | 6/2008 | Bommaraju | |
| 2008/0135640 | A1 | | 6/2008 | Velazquez et al. | |
| 2008/0230046 | A1 | | 9/2008 | Richardson et al. | |
| 2008/0283037 | A1 | * | 11/2008 | Dodo | 126/263.02 |
| 2009/0007899 | A1 | * | 1/2009 | Dodo | 126/263.02 |
| 2009/0025706 | A1 | | 1/2009 | Cho et al. | |

* cited by examiner

TUNABLE FLAMELESS HEATERS

CROSS-REFERENCE TO RELATED APPLICATIONS

This application claims the benefit of the filing of U.S. Provisional Patent Application Ser. No. 61/217,577, entitled "Tunable Flameless Heaters," filed on Jun. 2, 2009, and the specification thereof is incorporated herein by reference.

BACKGROUND OF THE INVENTION

1. Field of the Invention

The invention relates to portable flameless heating apparatuses and methods utilizing an exothermic chemical reaction to produce heat without the need for an external source of energy such as a fire or flame. Particularly, there is disclosed hereby a flameless heater based on the exothermic reaction of a magnesium-iron alloy in the presence of salt and water, which apparatus generates sufficient energy to heat an item, material or component, as an example, but not limited to, a meal, a beverage, or any other item for consumer, industrial and military markets. Specifically, this disclosure relates to a flameless heater apparatus and method whose heating capacity and performance can be selected and tuned at the time of manufacture, and which is easily used and has a long shelf life.

2. Background Art

The use of magnesium-iron super-corroding alloy to design flameless heaters has been known for several decades. In the presence of an activator such as salt, a super-corroding alloy, typically a magnesium-iron alloy reacts with water, resulting in an exothermic reaction which generates heat and evolves hydrogen gas. It is possible to design a heating apparatus which is portable, safe to store and transport, and convenient to use. A number of such portable flameless heaters, particularly for heating of food, are known.

For example, a flameless ration heater pad based on the magnesium-iron alloy is described in U.S. Pat. No. 4,522,190 to Kuhn, et al., the disclosure of which is incorporated herein by reference. Kuhn, et al. describe a flameless ration heater pad or cake which consists of a super-corroding metallic alloy such as magnesium-iron and other ingredients blended together and dispersed throughout a porous matrix of polymeric material, such as polyethylene. When such a pad is wetted with saline water, an exothermic reaction is initiated, releasing enough energy to heat a desired substance. The magnesium-iron alloy used by Kuhn et al. contained 5 atomic percent (10.8 weight percent) iron.

Another example of a flameless ration heater based on magnesium-iron alloy is described in U.S. Pat. No. 5,611,329 to Lamensdorf, the disclosure of which is incorporated herein by reference. Lamensdorf teaches about a flameless ration heater made by first creating a mixture of magnesium-iron alloy powder with salt and an anti-foaming agent. Next, the blended powder is evenly distributed and enclosed into pockets made by selective thermal bonding of two rectangular non-woven gas and water permeable plastic sheets.

Other references providing useful background include U.S. Pat. No. 6,248,257 to Bell et al., and U.S. Pat. No. 7,258,117 to Payen et al., both of which are incorporated herein by reference.

Such flameless ration heaters can be included into a device specially created for a particular use, such as for heating a single or multiple serving meal or beverage or any other application.

SUMMARY OF THE INVENTION

The invention of this disclosure is a method and an apparatus relating to flameless ration heaters. Such heaters are used to heat an item, such as container(s) of water or tray(s) of food, or any other application. Paramount aspects of the present method and apparatus are that the solid reactive ingredients (not including liquid reactant, typically water) are not all blended or mixed together at the time of apparatus fabrication. Rather, at least one key ingredient, preferably the active ingredient (typically a super-corroding alloy of magnesium and iron) in a dry powder form is kept physically segregated from all the other ingredients, such as catalysts (normally acids such as acetic or tartaric acid or acidic mixtures known in the art) and surfactants. In the present invention, the exothermic chemical reaction is initiated only after at least one (typically a dry powder catalyst) goes into aqueous solution after the application of water (saline or non-saline). The catalytic solution flows out, through, and about and among water-permeable pockets in the pouch-like apparatus which contain one or more other ingredients, including the active ingredient (e.g., the Mg—Fe alloy). Thus, the catalyst and the active ingredient do not come into effective contact until a flowing aqueous solution carries one or more of them to the other, and then mixes the inter-reactive ingredients to generate the desired heat. In a preferred embodiment, the apparatus incorporates the necessary activator, typically a salt, in dry powder form, and the application of plain water dissolves not only the catalyst but the salt activator also, and carries these solutions to mix with each other and to come in contact with the Mg—Fe alloy. The self-contained apparatus does not include any liquid reservoirs; water (whether saline or not) is separately and independently supplied.

There is disclosed hereinafter a method for flamelessly heating an item. Succinctly summarized, the method features the steps of: providing a pouch; defining at least two water-permeable pockets in the pouch; disposing in at least one pocket a dry powder active ingredient; disposing in another pocket, physically segregated from the dry powder active ingredient, a dry powder catalyst; and wetting the pouch with saline solution sufficient to penetrate the water-permeable pockets, causing a substantial portion of the catalyst to dissolve into solution; and then permitting the acidic saline solution to move amongst the water-permeable pockets to come in contact with the active ingredient and initiate an exothermic reaction in the pouch. The step of wetting the pouch may comprise applying a saline or non-saline aqueous solution to the pouch. If the apparatus pouch has no pocket holding a salt activator, it is necessary to apply a saline solution to the pouch to initiate the exothermic reaction. For those embodiments of the apparatus which incorporate a pocket holding a salt activator, merely applying plain, non-saline, water to the apparatus will generate a saline solution which in turn activates the desired reaction.

In the method, the step of providing a pouch optionally comprises providing two or more pouches connected together, and then defining one or more pockets in each of the pouches. Continuing in the method, there are disposed in the pockets of any one pouch one or more ingredients, such ingredients being selected from, but not limited to, the group consisting of an active ingredient, a catalyst, a powder salt activator, a powder surfactant, a hydrogen getter, and an inert material. The step of disposing in the pockets of any one pouch the ingredients preferably comprises disposing in those pockets two or more of the ingredients, wherein, at least one of the pockets holds the active ingredient. Such pouches can be connected together in a configuration to create a multi-pouch heater which provides optimal heating of the desired item.

Alternatively, the method may include a process whereby the step of defining at least two water-permeable pockets in the pouch comprises defining at least three pockets, and further comprises the steps of: disposing only the powder active ingredient in at least two pockets, as well as disposing in the other pockets in the pouch at least one other ingredient selected from the group consisting of a catalyst, a powder salt activator, and a powder surfactant. If none of the pockets contain an activator salt, the step of wetting the pouch may comprise applying a saline solution to the pouch. If at least one of the pockets holds a powder salt activator, then the step of wetting the pouch may comprise simply applying plain, non-saline, water to the pouch. The step of disposing in the other pockets in the pouch at least one other ingredient may comprise disposing a powder mixture of one or more of the other ingredients.

The method also includes a process whereby the heating performance of the apparatus may be predetermined, or "tuned," at the time of fabrication. In such process, the step of defining at least three pockets comprises sealing the pockets closed, and further comprises the step of selectively tuning the rate of the exothermic reaction by selectively measuring the disposition of the powder ingredient in the pockets. These measuring steps occur prior to sealing closed the pockets.

Defining at least two water-permeable pockets in a pouch preferably comprises creating non-frangible seams in the pouch. In the practice of the inventive method, it is not necessary to open or rupture any seam or barrier between pockets holding disparate reactive ingredients.

There also is disclosed hereinafter an apparatus generally concordant with the foregoing summarized methods. The inventive flameless ration heater apparatus comprises in a fundamental form a pouch; at least two water-permeable pockets within the pouch by non-frangible seams in the pouch; a dry powder active ingredient disposed in a first pocket; a dry powder catalyst disposed in a second pocket, physically segregated from the dry powder active ingredient, wherein the active ingredient, in the presence of a catalyst, react exothermally in the presence of a saline solution; and wherein when the pouch is wetted with saline water sufficient to penetrate the water-permeable pockets, a substantial portion of the catalyst dissolves into solution which solutions move amongst the water-permeable pockets to initiate an exothermic reaction in the pouch.

One possible embodiment of the apparatus features two distinct pouches that are connected together, with at least two pockets in a first one of the pouches and a single pocket in the second one of the pouches. In this dual-pouch embodiment, one or more ingredients are disposed in the pockets in the first pouch, which ingredients are selected from, but not limited to, the group consisting of an active ingredient, a catalyst, a powder salt activator, a powder surfactant, a hydrogen getter, and an inert material. Also, a single other ingredient is disposed in the pocket in the second pouch and also is selected from the group consisting of an active ingredient, a catalyst, a powder salt activator, a powder surfactant, a hydrogen getter, and an inert material, but this single other ingredient is selected to be one of the ingredients that is not disposed in any of the pockets in the first pouch. It is acceptable, in this embodiment, to have powder mixtures of two or more of the ingredients disposed in the pockets in the first pouch. The various pockets in the first pouch may contain a single ingredient or a mixture of ingredients, and the mixtures of ingredients may vary from pocket-to-pocket in the first pouch or may be a consistent mixture amongst the pockets. At least one pocket should contain the active ingredient. The active ingredient does not share a common pocket in any pouch with either the salt activator or the catalyst.

If, at least one of the pockets holds a powder salt activator, whereby wetting of the pouches with non-saline water causes a saline solution to move between the pouches and amongst the pockets. As the saline solution penetrates the water-permeable pockets, the various inter-reactive ingredients are brought into chemically effective contact, thus initiating the exothermic reaction. If none of the pockets hold a powder salt activator, the wetting of the pouches is accomplished by suing a saline solution.

Further to this embodiment of the apparatus, at least two water-permeable pockets in the pouch preferably comprise at least three pockets, in which instance the apparatus further features a configuration in which only the powder active ingredient (typically a Mg—Fe alloy) is disposed in at least two pockets, and at least one other ingredient selected from the group consisting of a catalyst, a powder salt activator, a powder surfactant, a hydrogen getter and an inert material is disposed in each of the other pockets in the pouch. If at least one of the pockets holds a powder salt activator, whereby wetting the pouch with a non-saline water causes the salt activator to dissolve into a saline solution which moves amongst the pockets in the pouch. This is the "water-activated" version of the apparatus. If none of the pockets hold a powder salt activator, the wetting of the pouches is accomplished by suing a saline solution.

BRIEF DESCRIPTION OF THE DRAWINGS

The attached drawings, which form part of this provisional patent application, are as follows:

FIG. 8(*b*) is a sectional view of the embodiment of FIG. 8(*a*), the section being taken along line A-A in FIG. 8A;

Like elements are similarly labeled throughout the various views.

DESCRIPTION OF PREFERRED EMBODIMENTS

Figure 1:
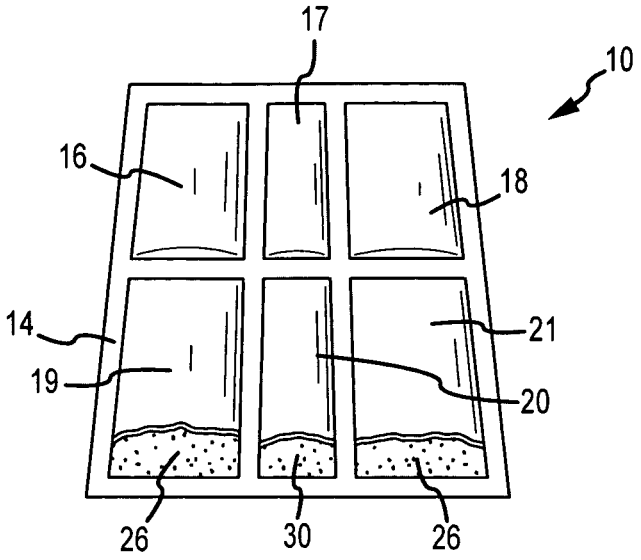
FIG. 1 is a perspective view, with portions broken away to reveal interior elements, of a first possible embodiment of the heat-releasing apparatus according to the present disclosure.

The present disclosure is directed to an innovative heater that is particularly well-suited as a "flameless ration heater" (FRH), which is used for heating food servings or beverage (single or multiple servings) using an exothermic chemical reaction. However, the disclosed apparatus and method are not limited in its utility to the heating of food or beverage, and may find utility in other applications where a convenient, quick, and safe flameless source of heat is desired. Also, methods for making and using the improved flameless heater apparatus are disclosed.

Further, in the presently disclosed apparatus, the dry powder chemical ingredients are not all blended together; rather, one or more of the ingredients is kept segregated from all others until the time of activation.

To use the present flameless ration heater, water is supplied to wet thoroughly a pouch with physically distinct pockets holding respective ones of the dry powder reactive ingredients. The water passes through the water-permeable pockets to dissolve the water-soluble ingredients, and the flowing aqueous solutions then freely mix with and wet the active ingredient to start the exothermic chemical reaction. For the reaction to take place, there must be an active ingredient (typically an alloy of magnesium, typically a super-corroding Mg—Fe alloy) in the presence of a catalyst ingredient (an acid such as tartaric acid) and an activator ingredient (a salt, such as NaCl). When the active ingredient is a Mg—Fe alloy, the reaction is generally characterized by: $Mg+2H_2O \rightarrow Mg(OH)_2+H_2$+heat (and water vapor).

Ingredients:

Thus the principal ingredients of the apparatus include an active ingredient, a catalyst, and an activator. Optional ingredients include one or more surfactants a hydrogen-getter substance, and other inert materials.

Table 1 below shows a list of ingredients, in approximate weight percentage ranges, for the presently disclosed heat-releasing apparatus. However, the scope of the invention is not limited by the content listed in Table 1; Table 1 offers some generalities typical to the present apparatus and method.

TABLE 1

| # | FUNCTION | INGREDIENT | TYPICAL CONTENT |
|---|---|---|---|
| 1 | Active Ingredient | Super-Corroding Metallic Alloy such as Magnesium-Iron Alloy or Other Powders | Balance |
| 2 | Catalyst | Dry Acid Granules such as Tartaric Acid or Other Granules | up to 20% |
| 3 | Surfactant | Dry Surfactant (optional) | up to 2% |
| 4 | Activator | Salt Granules (optional) such as Sodium Chloride or Other Granules | 0 to 12% |

The active ingredient according to this disclosure preferably is a powdered super-corroding magnesium-iron alloy preferably containing approximately up to 12 weight percent of iron. The magnesium-iron alloy most preferably contains about 5 weight percent (2.25 atomic percent) of iron. Optionally, the active ingredient may be an alloy of magnesium, iron and a hydrogen getter, the hydrogen-getter being optional. Alternatively, the active ingredient could be a blend of a magnesium-iron alloy and a hydrogen getter or an inert material. A hydrogen-getter or an inert material may be included when, according to principles known in the pertinent art, the character of the necessary ingredients, or the intended use of the apparatus, suggests the need for the decreased release of hydrogen. The disclosed active ingredient is not limited to the stated alloy or the stated composition of the alloy.

The preferred catalyst according to this disclosure is a tartaric acid, or acetic acid, or citric acid, or any similar mild acid which controls or modifies the pH of the activating solution and/or acts a catalyst for the heat-generating reaction. However, the catalyst is not limited to the stated ingredients or stated amounts. The surfactant, which is optional, can be any known material that can help control or modify the surface energy or surface tension of the activating solution.

The preferred activator according to this disclosure is a salt such as sodium chloride; however, the disclosed activator is not limited to the stated salt or stated amount. Also, in referring to Table 1, it should be understood that while an activator is necessary for the desired exothermic reaction to occur, it may or may not be an integral part of the apparatus itself. Rather, the activator, such as a salt, in some embodiments can be independently added from a separate source during the actual practice of the invention. Thus, depending on the embodiment utilized, either water or a saline solution is needed to initiate the heat-releasing reaction. If the salt has been incorporated into the apparatus, water is used to initiate the reaction ("water-activated" embodiment of the apparatus). If salt has not been incorporated into the apparatus, a saline solution is needed to initiate the reaction ("saline-activated" embodiment). Alternatively the catalyst, for example an acid, can also be incorporated into the saline solution. Further, as an alternate, the end user can add or sprinkle salt (or a mixture of salt and tartaric acid) on the apparatus and initiate the reaction using plain water.

The ingredients, including the active ingredient (e.g., a super-corroding metallic alloy), the catalyst (e.g., tartaric acid, or may be acetic acid), and optionally the activator (e.g., sodium chloride) and/or surfactant are held separately within various sealed pockets of a water-permeable non-woven pouch. At least some of ingredient remains segregated in separate pockets until such time that water or a saline solution is added to the apparatus, at which time the various ingredients dissolve into the aqueous solution and can exit their respective pockets to permit general mixing of ingredients and initiation of the desired exothermic reaction.

In this disclosure and claims, "powder" refers to particles, that is, a solid substance in the form of tiny loose particles or agglomerates; a solid that has been pulverized. "Frangible" means readily torn, opened, or ruptured, and "non-frangible" in this disclosure refers to a seam or barrier that is relatively durable and not intentionally devised or intended to be opened, ruptured, torn or broken. "Water-permeable" describes a material through which water readily passes, a material that is a substantially negligible barrier to the passage of an aqueous solution.

Figure 2:
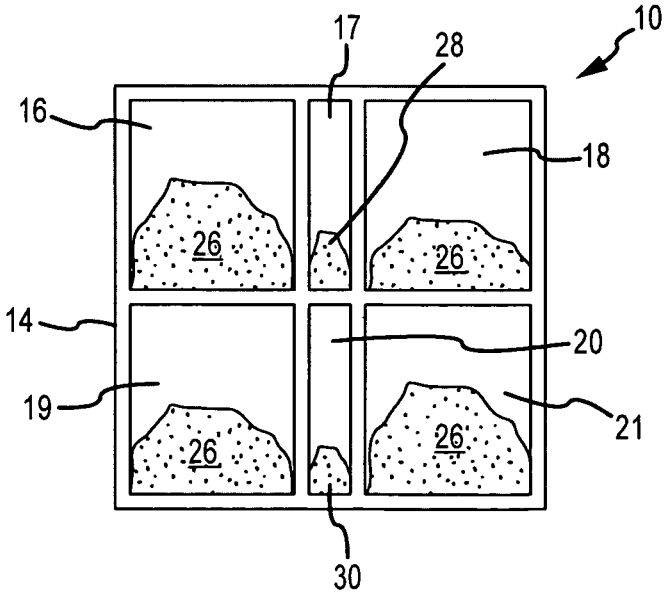
FIG. 2 is a schematic sectional view of the apparatus shown in FIG. 1.

Apparatus Description:

Reference is made to FIGS. 1 and 2 showing a water-activated, heat-releasing apparatus 10 according to the present disclosure. In the illustrated example, the apparatus 10 is a water-permeable non-woven fabric pouch 14 having six pockets 16-21 arranged in two rows. Each row has three pockets, two large pockets 16, 18 and 19, 21 on the outside, with small pockets 17 and 20 in the middle. In this configuration, the active ingredient 26, for example the dry powder super-corroding magnesium-iron alloy, is roughly evenly distributed among the four large pockets 16, 18, 19 and 21. The catalyst 28, for example tartaric acid powder, is held in one of the small pockets 17. The activator 30, for example sodium chloride powder, is sealed in the other small pocket 20. In the alternative embodiment of a saline-activated apparatus, the small pocket 20 is empty or the catalyst 28 only is roughly evenly distributed between the two small pockets 17 and 20.

Figure 3:
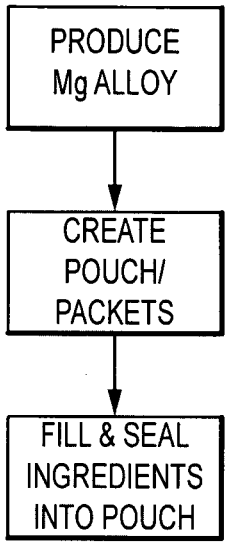
FIG. 3 is a flowchart illustrating generally a method for fabricating a heat-releasing apparatus according to the present disclosure.
Figure 4A:
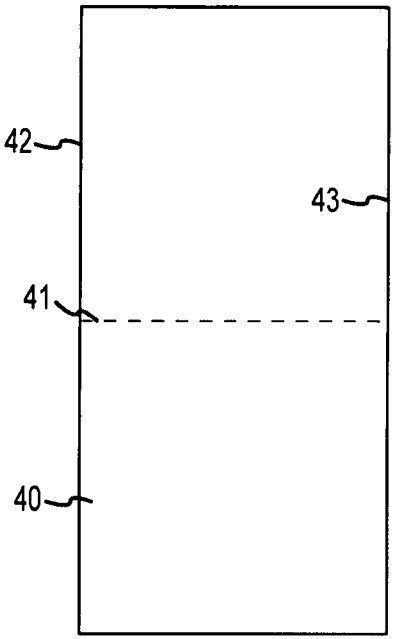
FIGS. 4(*a*)-(*e*) are a series of schematic views showing a heat-releasing apparatus according to the present disclosure in selected stages of fabrication, illustrating in part a manufacturing method according to the present disclosure.
Figure 4B:
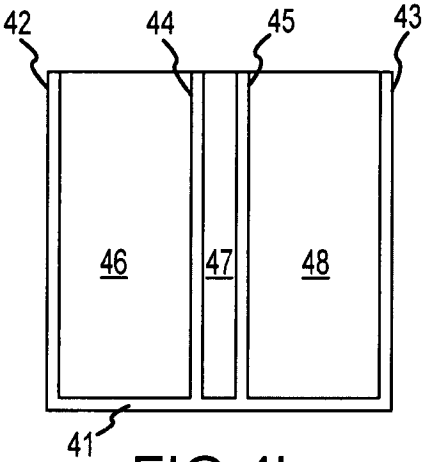
Figure 4C:
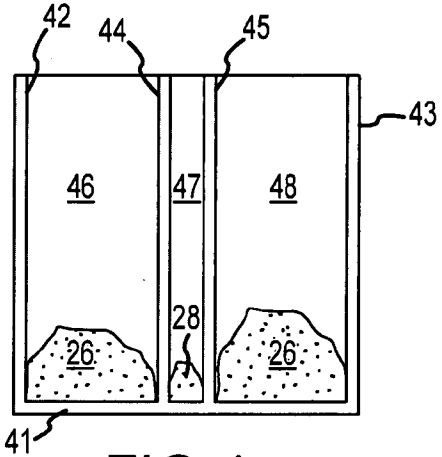
Figure 4D:
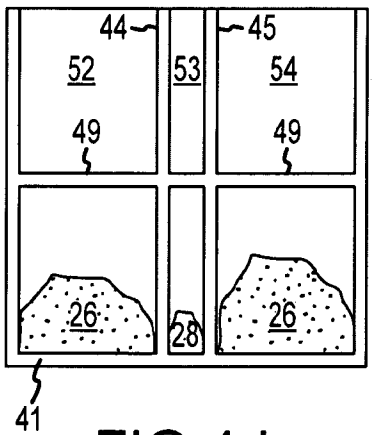
Figure 4E:
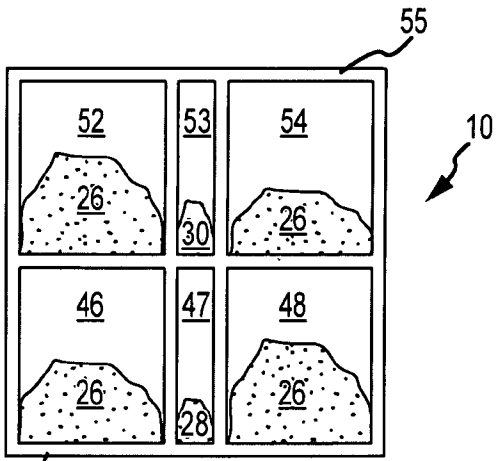
Figure 5C:
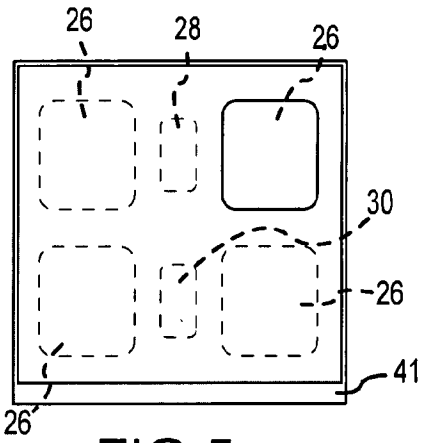
FIGS. 5(*a*)-(*d*) are a series of schematic views showing a heat-releasing apparatus according to the present disclosure in selected stages of fabrication, illustrating in part an alternative manufacturing method according to the present disclosure.
Figure 5D:
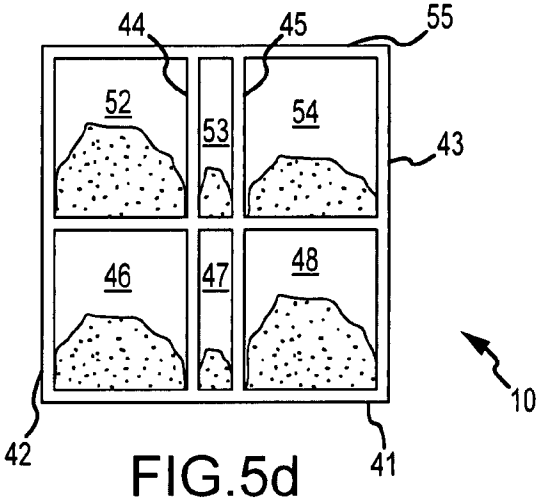
Figure 5B:
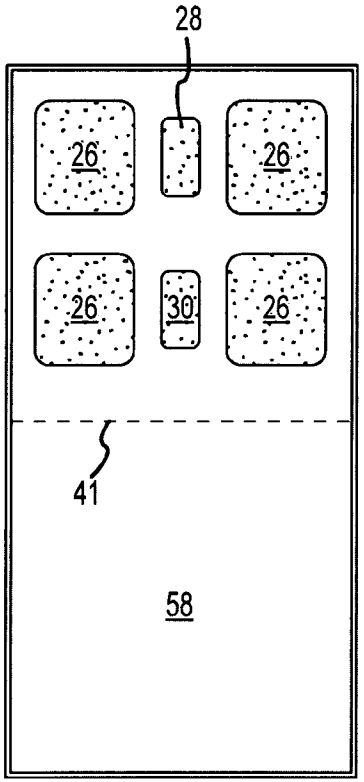
Figure 5A:
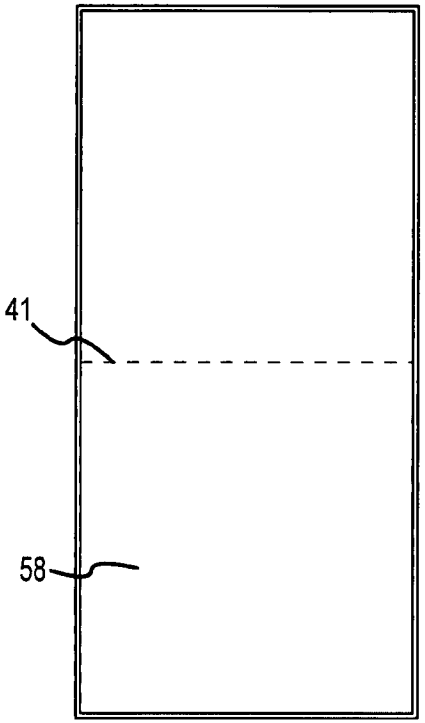

Fabrication Methods:

There also is disclosed hereby a process for efficiently fabricating the apparatus according to the invention. FIG. 3 provides a general illustration of a method for fabricating the heat-releasing apparatus 10. The first step is to manufacture the active ingredient 26, which in all embodiments preferably is a magnesium-iron alloy powder wherein iron particles are alloyed with or embedded within a magnesium matrix. Optionally, a hydrogen getter or an inert material may be included into the active ingredient mix. Preferably, the hydrogen getter composition and/or the inert material are incorporated directly with the active ingredient alloy as part of the alloy manufacturing process. As an example, a preferred method to produce the magnesium-iron alloy is by co-milling pure magnesium powder and iron powder. (The production of the magnesium-iron alloy is not limited to the stated method.) Next, optionally, some—but not all—of the ingredients may be mixed together. A water-permeable sheet, for example a non-woven fabric material, then is folded, and a pouch 14 is created by sealing (by any suitable means) two sides of the folded sheet. Individual pockets (e.g., pockets 16-21) are also created by selectively seaming the pouch 14. These pockets are filled respectively with the various ingredients, and the pouch 14 is finally sealed such that the ingredients are held within the heat-releasing apparatus 10.

Several possible options exist for the more specific step-by-step manufacture of the apparatus 10. A few possible production methodologies are now presented, but the disclosure of these options is not intended to be limiting.

As an example, FIG. 4 illustrates a "fill and seal" type process to create a six-pocket heat-releasing apparatus 10. As seen in FIG. 4(*a*), fabrication begins with a rectangular piece of water-permeable non-woven sheet 40. This sheet 40 is first folded at the "fold-line" 41 shown in FIG. 4(*a*). The two sides 42, 43 of the sheet 40 are sealed to create a pouch with a single void. Next, non-frangible seams 44, 45 are selectively defined, as by heat welding or the like, onto the pouch to create three pockets 46-48, as depicted in FIG. 4(*b*). Two pockets 46, 48 are provided (at least partially filled) with active ingredient 26 (e.g. the super-corroding alloy powder), and the third pocket 47 is provided with a suitable powdered catalyst 28 (or activator salt 30, including, but not limited to NaCl), as seen in FIG. 4(*c*). Thus FIG. 4(*c*) shows the first "row" provided with measured quantities of ingredients. The powder-containing pockets 46-48 are then sealed with a non-frangible mid-seam so that the ingredients 26 and 28 (or 30) remain within the first row of filled (or partially filled) pockets, as illustrated in FIG. 4(*d*). This creates a second row of pockets 52, 53, 54.

Next, two pockets 52, 54 in the second row are provided with the active ingredient 26 and the third and middle pocket 53 is provided with an activator 30 such as a salt (or catalyst 28, such as, but not limited to, tartaric acid). It is noted that, for a water-activated embedment, if the first middle pocket 47 is provided with a catalyst, the other middle pocket 53 is provided with an activator, and vice-versa. For a saline-activated embedment, one pocket 47 or 53 may be empty and the other contains the catalyst 28 or both 47 and 53 may contain the catalyst 28. Referring lastly to FIG. 4(*e*), the second row is sealed with an appropriate top non-frangible seam 55 to complete a six-pocket heat-releasing pouch apparatus 10.

A variation of the "fill and seal" process is the "seal, fill and seal" process wherein two water-permeable non-woven sheets are used instead of just one. The variation can also be understood in reference to FIG. 4(*a*)-(*e*), except that two sheets 40 are brought together and sealed to create seams 41, 42, 43, 44 and 45, thus creating pockets 46, 47 and 48. Next, ingredients 26 is filled into pockets 46 and 48 and ingredient 28 or 30 is filled into the pocket 47. Next, seam 49 is created, further ingredient 26 (or potentially alternative ingredient 28 or 30) is filled into pockets 52 and 54 and ingredient 28 or 30 is filled into pocket 53. Finally, seam 55 is created and optionally the fabric cut to create the embodiment 10.

In an alternative "drop, fold, and seal" fabrication process, a water-permeable sheet 58 (for example, of non-woven fabric) is laid flat on a working area as shown in FIG. 5(*a*). The various ingredients 26, 28, 30 are measured as to quantity and controllably dropped or deposited at pre-determined locations on one-half of the sheet 58, as seen FIG. 5(*b*). Referring to FIG. 5(*c*), the sheet next is folded "in two" along fold line 41 so as to cover the ingredients. The doubled-over sheet 58 is selectively sealed along selected lines to create non-frangible seams 42, 43, 44, 45, and 55 that isolate the ingredients 26, 28, 30 within their individual respective pockets 46-48 and 52-54, thus creating the apparatus 10 shown in the sectional view of FIG. 5(*d*). The end product 10 is substantially the same in final physical configuration as in the "fill and seal" method discussed above with reference to FIGS. A(a)-(e).

A variation of the "drop, fold, and seal" process is the "drop and seal" fabrication process. In this method, two water-permeable sheets 58 are utilized. The variation also can be understood yet with reference to FIGS. 5(*a*)-(*d*), except that a first one of two water-permeable sheets is placed on the working surface; in this variation, the first sheet is about one-half the size of the sheet utilized in the variation explicitly shown in FIG. 5(*a*). The ingredients 26, 28, 30 are then measured and placed at pre-determined locations on the sheet. Next, instead of folding over a single sheet, a second, separate sheet is placed on top of the first sheet in alignment therewith to cover the ingredients. Finally, the two sheets are selectively sealed to create the intermediate and peripheral seams that isolate the ingredients 26, 28, 30 within their individual corresponding pockets, as seen in FIG. 5(*d*). In this variation, thus, there is no fold line 41 (FIG. 5(*a*)), and instead there is one additional seam made in lieu of the folded edge of the variation explicitly seen in FIGS. 5(*a*)-(*c*).

As another option, a pouch with unfilled pockets may be first created by folding and sealing of a water-permeable fabric. As a next independent step, the empty pockets are filled with ingredients as desired. Such a flameless-heat-releasing apparatus, or multiple such flameless-heat-releasing apparatus, can be optionally sealed in a water-proof plastic bag for the purpose of transportation.

A heat-releasing apparatus as described above may be used in operative combination with any of a variety of additional structural elements known in the art, including trays, boxes, bags, or other suitable containers, including containers having all or portions of their structure substantially impermeable to water, to provide a portable device for providing flameless heat for heating food, beverages, or other items.

Using a Heat-Releasing Apparatus:

There can be a variety of applications for the heat-releasing apparatus described above. The description below on how to use a heat-releasing apparatus are for illustration purposes only and shall in no way be construed to limit the scope of the invention.

A multi-pocket heat-releasing pouch apparatus, as described above, may be placed within a container or tray, and the item to be heated placed in a resting position upon the heat-generating apparatus. Water (plain or saline, depending on the embodiment utilized) may then be poured into the container or tray, thereby wetting the water-permeable pouch. Water penetrates the permeable sheet material and contacts the ingredients contained within the various pockets of the pouch. While the different ingredients initially are physically separated in discrete pockets of the apparatus, certain ingredients dissolve in the added water and their respective solutions are free to exit the pockets and mix freely.

For example, when a water-activated flameless heat-releasing apparatus according to the present disclosure is activated using plain water, the water permeates into the various pockets, including those containing salt and/or tartaric acid. Some of the salt and tartaric acid dissolve in the water. The resulting acidic saline solution ("activating solution") escapes the activator- and catalyst-containing pockets, and then penetrates into the other pockets of the apparatus to come into contact with the active ingredient (e.g., Mg—Fe alloy); such contact initiates the exothermic reaction and generates the desired heat. As the activating solution heats up, it dissolves further the balance of the catalyst and activator powders, and the exothermic reaction continues till the ingredients are spent. The spent material is magnesium hydroxide or magnesium oxide or a combination of two. These are inert materials and can be discarded as regular trash.

Again, a central feature of the apparatus is that some of the ingredients are kept mostly unmixed until the actual time for use. The apparatus features a water-permeable pouch, preferably fabricated from an unwoven felt or fabric. Seams provided in the pouch define separate, closed, pockets within the pouch, whereby each ingredient is physically segregated in its own pocket. (For example, a pouch has three pockets, one containing salt, one containing tartaric acid, and one containing a magnesium-iron powder.) The seams may be created by thermal sealing, or by ultrasonic sealing, or by using an adhesive or any other such method.

The exothermic reaction is triggered by pouring water or saline solution onto the apparatus, or alternatively, partially immersing and optionally agitating the apparatus in water or saline solution. The water-soluble ingredients (e.g., salt, tartaric acid) go into solution and then, and only then, do these ingredients escape their respective pockets by penetrating outward through the permeable pouch material. The solution transports the dissolved ingredients to other pockets in the apparatus. Thus, via such an activating solution, the dissolved ingredients can be transported to pockets containing the other (perhaps non-soluble or less-soluble) ingredients, for example the magnesium-iron alloy powder. The overall result is that all the ingredients eventually are wet-mixed by the action of the moving solution flowing through the permeable pouch material and into (and out of) all the separate pockets. But, again, further to advantages of the invention, at least some of the dry ingredients are not pre-mixed; they are physically separated into discrete pockets until a solution is applied to mix them. Further, the pockets in the pouch are defined in a preferred embodiment by non-frangible seams. This feature safeguards the integrity of the physical segregation of the dry powder ingredients in different pockets prior to use. It also distinguishes the apparatus from known devices requiring the rupture of package compartments, at the time of use, to permit ingredients physically to come in contact.

Examples of Apparatus Design:

The heat-releasing apparatus thus described can be manufactured in various shapes and configurations. At a minimum, there are two pocket sections in the apparatus—one section holding the active ingredient (Mg—Fe) alloy, and the other holding a second ingredient or a mixture of ingredients. In theory, the heat-releasing pouch apparatus may have any number of pockets greater than two; the maximum is limited mainly by pragmatics, including the size of the starting sheet and the end application. The pockets of the heat-releasing apparatus can be of any desired shape or size and arranged in any desirable configuration. The type and amount of reactive ingredients can be placed within the pockets in any desirable configuration; the amount and location of different reactive ingredients in the apparatus permits the apparatus to be "tuned" at the time of fabrication to have a predetermined heating performance characteristic. Thus, the pocket sizes, shapes, and configurations and the type and amounts of ingredient within the respective pockets can all be varied to optimize and fine-tune the performance of the apparatus for a given end-use application.

Further, as an option, it is possible to blend some, but not all, of the ingredients together—for example, the catalyst (e.g., tartaric acid) and activator (salt) may be blended together. It is noted, however, that not all the reactive dry powder ingredients are blended together. The active super-corroding metallic alloy active ingredient preferably remains segregated in its own corresponding pocket of the apparatus until activation commences with the deliberate application to the apparatus of water or saline solution. The metallic alloy active ingredient may have an inert material and/or a hydrogen-getter incorporated therewith; thus in certain preferred embodiments the pocket(s) holding active ingredient may contain only active ingredient or a composition consisting only and exclusively of the alloy and a hydrogen getter, or of only the alloy and an inert material, or of only the alloy, a hydrogen getter, and an inert material.

The apparatus may consist of more than one pouch, different pouches may be made from different materials, and one or more pouches may have multiple pockets, and the pouches may be assembled together into one cohesive unit, and the ingredients may be brought together at time of use.

Figure 6:
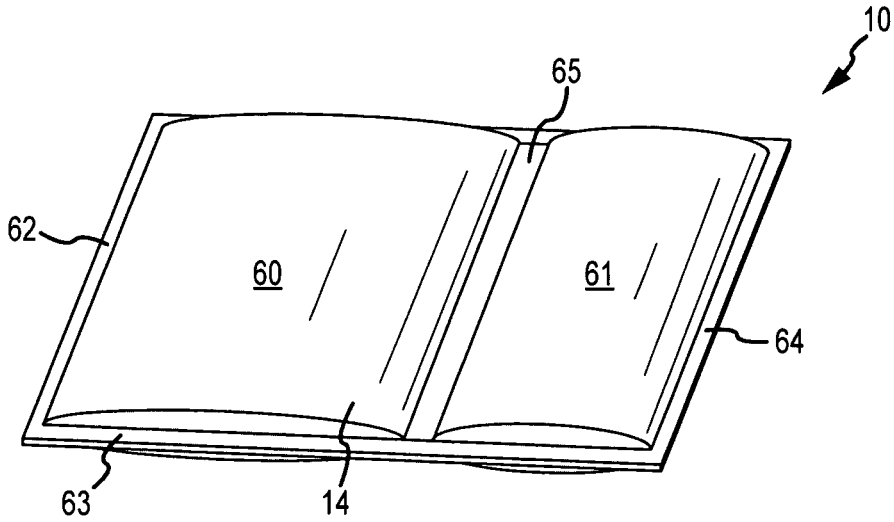
FIG. 6 is a perspective view, with portions broken away, of a two-pocket embodiment of a heat-releasing apparatus according to the present disclosure, there being a mixture of salt and activator compositions situated in the right-side pocket.

For example, a two-pocket embodiment of the apparatus 10 may have the super-corroding active ingredient 26 situated in one pocket, and the catalyst 28 and/or activator 30 in a second pocket 61, as seen in FIG. 6. If the second pocket 61 contains only a catalyst, the apparatus 10 is saline-activated. If it contains a selected mixture of catalyst and activator, the apparatus is a water-activated version of the invention. In such an embodiment, the edges of the pouch 14 are sealed with closed seams 62, 63, 64. A central divider seam 65 separates the pockets 60 and 61.

Or, a three-pocket embodiment of the heat-releasing apparatus 10 may have Mg—Fe alloy powder in two large pockets and the catalyst (or catalyst mixed with the activator) in one other small pocket. Further yet, the Mg—Fe alloy may be in a single (comparatively large) pocket, with the catalyst in a second (smaller) pocket, and the activator in a third (small) pocket. Thus one preferred embodiment of the flameless heater apparatus may consist of a pouch with three pockets. Two large outside pockets may each contain approximately 10 grams of the active ingredient Mg—Fe alloy powder, and a center small pocket may contain approximately 2 grams of tartaric acid. Such an apparatus could be used to heat a seven- to nine-ounce meal serving.

Figure 7:
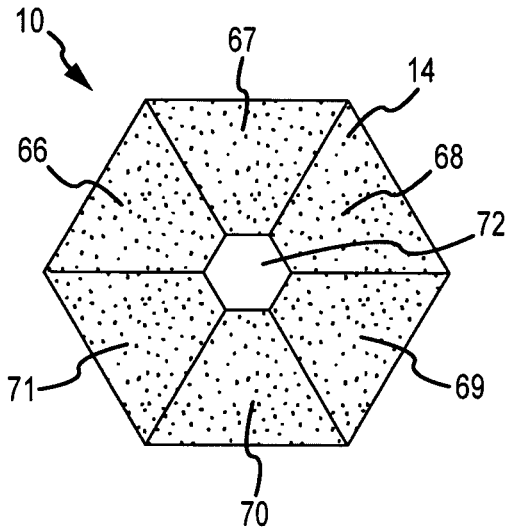
FIG. 7 is a schematic sectional view of yet another alternative embodiment of a heat-releasing apparatus according to the present disclosure, illustrating a hexagonal configuration having a plurality of sectional pockets containing active ingredients situated peripherally around a central pocket containing an activator composition.

Or, the heat-releasing apparatus 10 optionally may be crafted to define a hexagonal shape, as depicted generally in FIG. 7, as a pouch 14 with six peripheral pockets 66-71 for the active ingredient (e.g., magnesium-iron alloy powder) and a central pocket 72 for a catalyst. The various pockets 66-72 are defined by non-frangible seams (again, created by suitable known means) which separate the respectively contained dry ingredients.

Figure 8A:
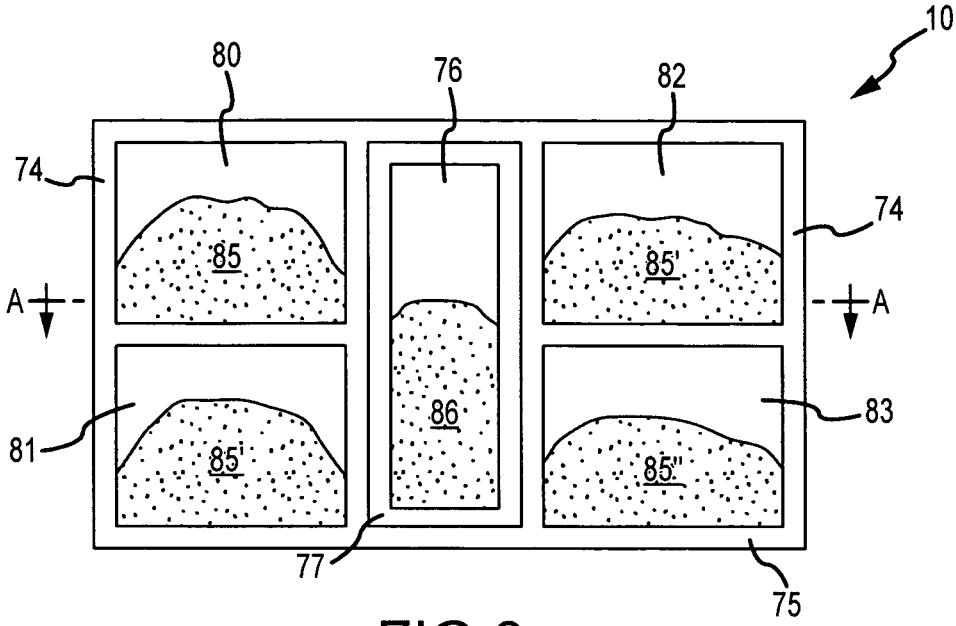
FIG. 8(*a*) is a schematic view of yet another alternative embodiment of a heat-releasing apparatus according to the present disclosure, illustrating a pouch of rectangular configuration composed of a water-permeable material and having a plurality of sectional pockets containing different or same ingredients, and an additional pouch which may be made from a different type of water-permeable material and may contain a different ingredient.
Figure 8B:
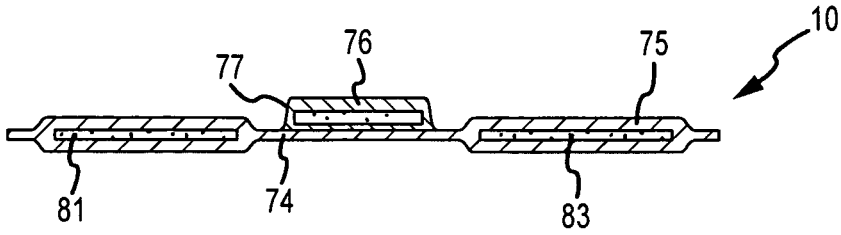

As seen in FIGS. 8(*a*) and 8(*b*), the apparatus 10 alternatively may be made with two pouches 74 and 76, preferably but not necessarily fabricated according to a method described hereinabove, which have been connected together. A larger pouch 74 made with Fabric Type-1 75 has four pockets 80, 81, 82, 83 holding two or three different ingredients 85, 85', 85" (for example, Mg—Fe alloy powder, hydrogen-getter compositions, surfactants, or catalysts). A smaller pouch 76 made with Fabric Type-1 or Type-2 77 defines a pocket holding an ingredient 86 which preferably but not necessarily is different from those held in the larger pockets 80-83 (for example, a catalyst or an activator, as selected at the time of manufacture, and depending upon the contents of the larger pockets, whether the apparatus 10 is water- or saline-activated, and the desired heating characteristics of the apparatus). The small pouch 76 preferably is connected or attached to the larger pouch 74, as indicated in FIGS. 8(*a*) and 8(*b*).

The two pouches 74, 76 may be connected together by known techniques such as gluing, thermal sealing, ultrasonic bonding, sewing etc. A further extension of this concept allows for a design of an apparatus 10 in which practically any type of geometric configuration is possible, with any combination of ingredients placed in any spatial orientation, with the flexibility of having at least one dry ingredient that is enclosed in a pouch material that is different than the pouch material enclosing and containing one or more other dry ingredients. Combining multiple pouches 74, 76 made from differing materials permits the pouches to have different permeability to water (or to have some other distinctive physical characteristic), or pouches made of materials of different costs, for example. Further a variety of geometric configurations of multi-pouch heaters can also be designed to provide heat preferentially to certain sections of the item, the material or the component being heated.

Figure 9:
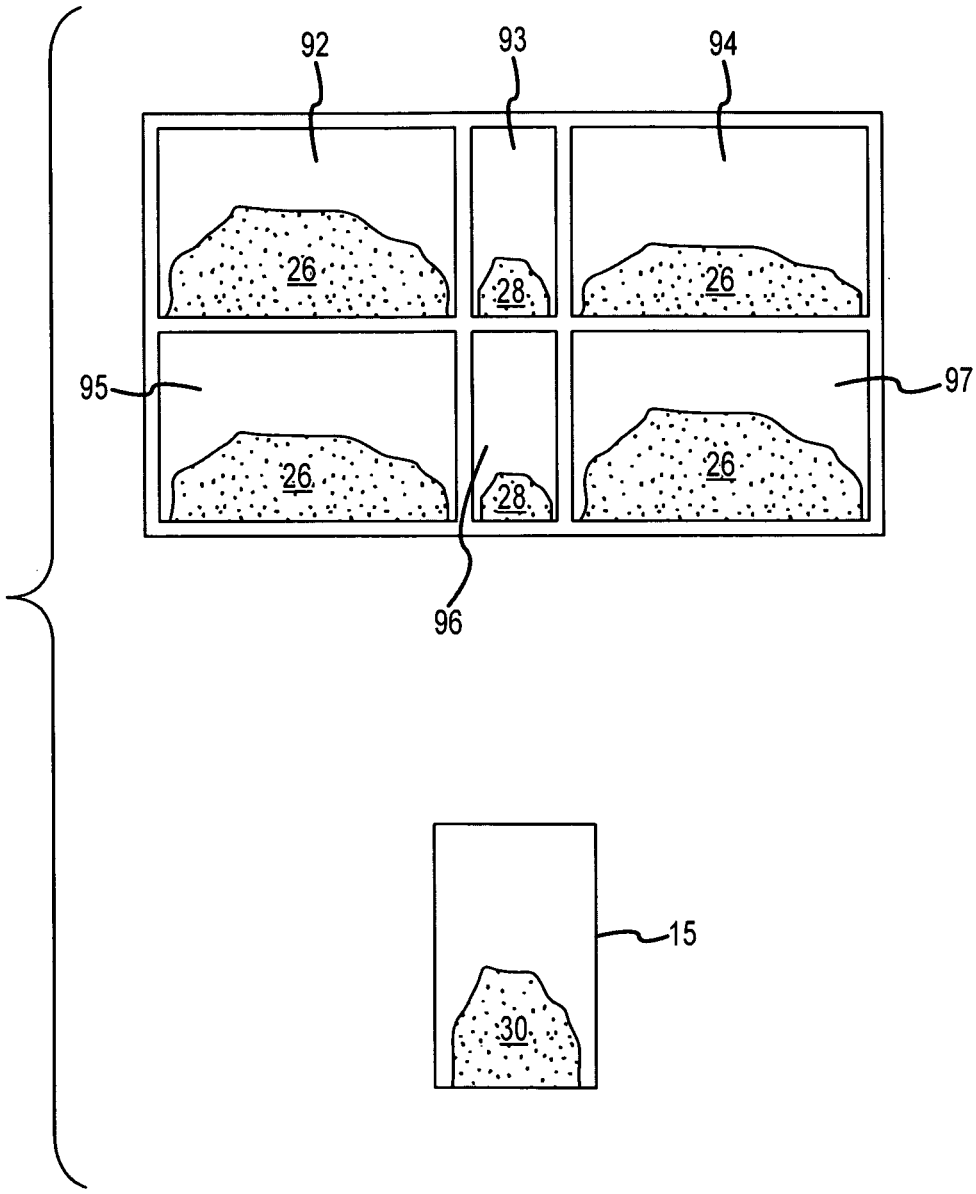
FIG. 9 is a schematic of another alternative embodiment of the flameless heater apparatus according to the present disclosure, showing a six-pocket pouch with, for example, approximately 15 grams of magnesium-iron alloy in each of the four outer pockets and approximately 3 grams of tartaric acid in each of the two inner pockets, also showing a separate pouch containing about 8 grams of salt to be sprinkled onto the six-pocket pouch prior to activation with water.

Referring to FIG. 9, another embodiment of the apparatus may consist of a flameless heater pouch 14 with six pockets. Each of four large outer pockets 92, 94, 95, and 97 contains approximately 15 grams of the magnesium-iron alloy 26, and each of the two smaller center pockets 93 and 96 contains approximately 3 grams of catalyst tartaric acid 28. A separate pouch 15 is packaged together with the main pouch (as in a kit). The separate container 15, which for example may be made from plastic or paper, contains approximately 8 grams of sodium chloride powder 30. This embodiment of the flameless heater apparatus is activated by the user opening the separate container 15 and distributing the salt widely upon the exterior of the main pouch 14. With the salt from the separate container 15 upon the permeable main pouch 14, the apparatus is activated by the user thoroughly wetting the main pouch 14 with plain water. Such an embodiment may be used to heat, for example, approximately 50 ounces of water for making hot coffee, hot tea, hot cocoa, or hot soup.

FIG. 9 also suggests a possible alternative method, whereby an ingredient 30 is incorporated in a separate solution in a waterproof separate container 15. Such an ingredient may be selected from the group consisting of a surfactant, a catalyst, and a salt activator, and wetting a pouch may involve placing the separate solution directly upon the exterior of the pouch immediately at the time of use. The separate solution is allowed to permeate the pockets and transport the various ingredients in solution to intermix and react when contacting the super-corroding alloy.

Figure 10:
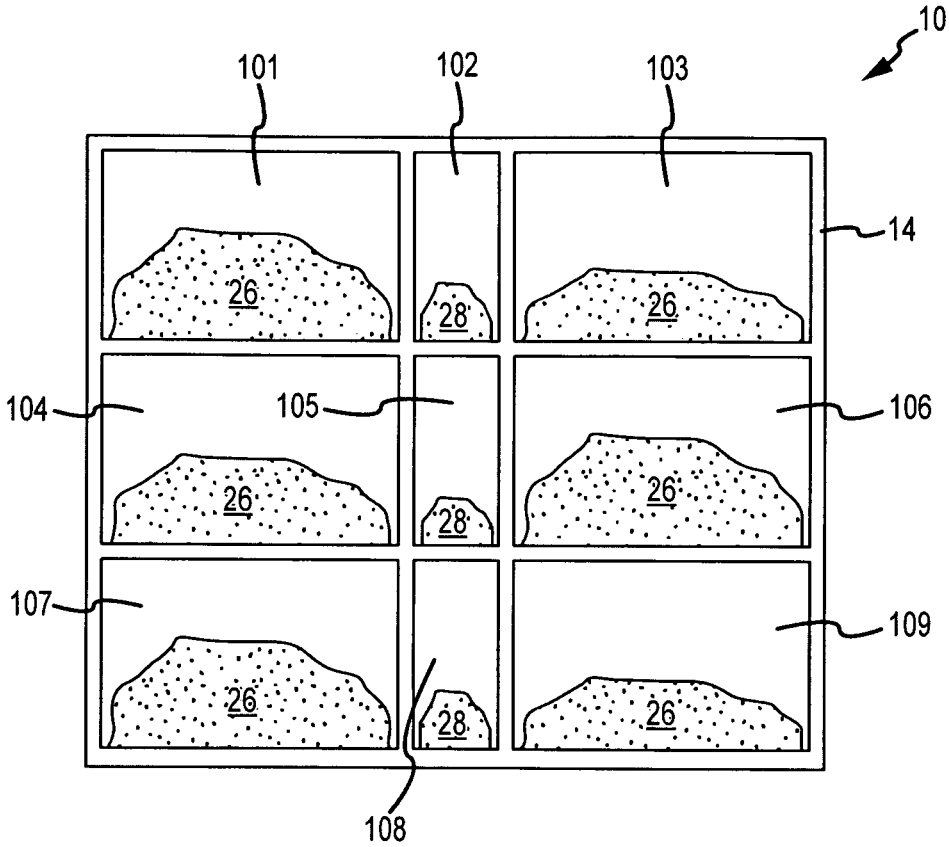
FIG. 10 is a schematic of another embodiment of the flameless heater apparatus according to the present disclosure, showing a nine-pocket pouch with, for example, approximately 20 grams of magnesium-iron alloy in each of the six outer pockets and approximately 4 grams of tartaric acid in each of the three inner pockets; such an apparatus may be activated with a saline solution and is capable of heating a nominally 60- to 100-ounce meal.

FIG. 10 illustrates schematically yet another preferred embodiment of the apparatus 10, which consists of a flameless heater pouch 14 with nine pockets 101, 102, 103, 104, 105, 106, 107, 108, 109, defined in accordance with previous explanations hereinabove, with dividing seams pressed or provided into a pouch 14 composed of water-permeable woven or non-woven material. Each of six large outer pockets 101, 103, 104, 106, 107, and 109 each contains, for example, approximately 20 grams of the magnesium-iron alloy powder 26. Each of the three small center pockets 102, 105 and 108 contains, for example, approximately 4 grams of tartaric acid 28 (with or without a surfactant). Such an apparatus is activated by allowing a saline solution to permeate the pouch 14 to wet the ingredients, and allowing the resulting solution to move between and amongst the various pockets 101-109. An apparatus 10 so configured could be used to heat a multi-serving 60-ounce to 100-ounce meal.

As another example, yet another preferred embodiment of the apparatus may be configured as shown in FIG. 10, being a flameless heater with nine pockets. In this alternative embodiment, the six large outer pockets 101, 103, 104, 106, 107, and 109 each contain approximately 30 grams of the active ingredient and the three small center pockets 102, 105 and 108 each contains approximately 6 grams of tartaric acid. Such an apparatus 10 also is activated using an applied saline solution, and would generate sufficient heart energy to heat approximately 100 to 130 ounces of water.

Thus, a wide range of shapes and configurations are possible for the apparatus. With the physical segregation of the catalyst and/or the salt activator from the super-corroding alloy active ingredient, prior to use of the invention, as the basic specification, the apparatus can be fabricated with any number of pockets in a wide variety of positional relationships. Further, each pocket may contain a single ingredient (often the active ingredient), or may contain mixtures of ingredients (e.g., selected mixtures of one or more other ingredients such as a catalyst, salt activator, a surfactant, and/or a hydrogen getter). In other embodiments, any particular pocket may hold only one single ingredient, such as the salt activator, or only a surfactant, or only a catalyst. Also, in some embodiments the active ingredient may share a pocket with one or more inert ingredients, or perhaps a hydrogen getter, without departing from the scope of the invention. The specific design is selected based on the application and the configuration of the heating device for that application. Further, the configuration of the apparatus is influenced by the need to achieve optimal heat transfer to the food/beverage being heated in a given device.

Fine-Tuning Performance:

Depending on the particular application, there may exist different performance criteria for flameless ration heaters. A common way of evaluating the performance of flameless ration heaters is to measure and record temperature versus time while heating a certain amount of water which is equivalent to the food or beverage to be heated for that application. Typically, such tests are conducted using a set-up which simulates the device whose performance is being evaluated.

Table 2 below compares the performance of the presently disclosed apparatus with that of a previously known flameless ration heater product. Preferred performance criteria for the presently disclosed apparatus are to achieve a temperature increase (ΔT) of at least 100° F. in less than 45 minutes when heating a 90 ounce tray of water. The Known Product was able to achieve a ΔT of 100° F. in about 24 minutes, reaching 117° F. in 45 minutes and cooling down to 108° F. in two hours. In contrast, Table 2 shows the presently disclosed powder flameless ration heater (of FIG. 10) was tested and achieved a ΔT of 100° F. temperature in just 20 minutes, reaching 118° F. in 45 minutes and was still at 118° F. in 2 hours.

TABLE 2

Performance of Present Apparatus vs. Known Products

| | TIME FOR | TEMPERATURE INCREASE (ΔT) AT | | | |
|---|---|---|---|---|---|
| HEATER | ΔT = 100° F. min. | 30 min. ° F. | 45 min. ° F. | PEAK ° F. | 120 min. ° F. |
| Performance Criteria | <45 | | ≥100 | | |
| Known Product | 24 | 110 | 117 | 120 | 108 |
| Present Apparatus | 20 | 107 | 118 | 122 | 118 |

The presently disclosed apparatus more than satisfied the preferred performance criteria. Notably also, this apparatus achieved the target temperature 16 percent faster and maintained a 10° F. higher temperature differential compared to the Known Product. Thus, the disclosed apparatus has a performance advantage over previously known devices.

In designing and fabricating the present heat-releasing apparatus for a given application, it is possible, with very limited experimentation and by application of principles of chemistry known to those skilled in the art, to tune the performance of the apparatus by changing the levels of various ingredients and/or the structural configuration of the product. As an example, it is possible to modify how quickly water is heated, the peak temperature achieved, and/or how long the material remains hot by changing the levels of the various ingredients in the sections of the apparatus. Further, the reaction dynamics can be controlled and fine-tuned by modifying the size, shape, and/or placement of the pockets within the apparatus.

Figure 11:
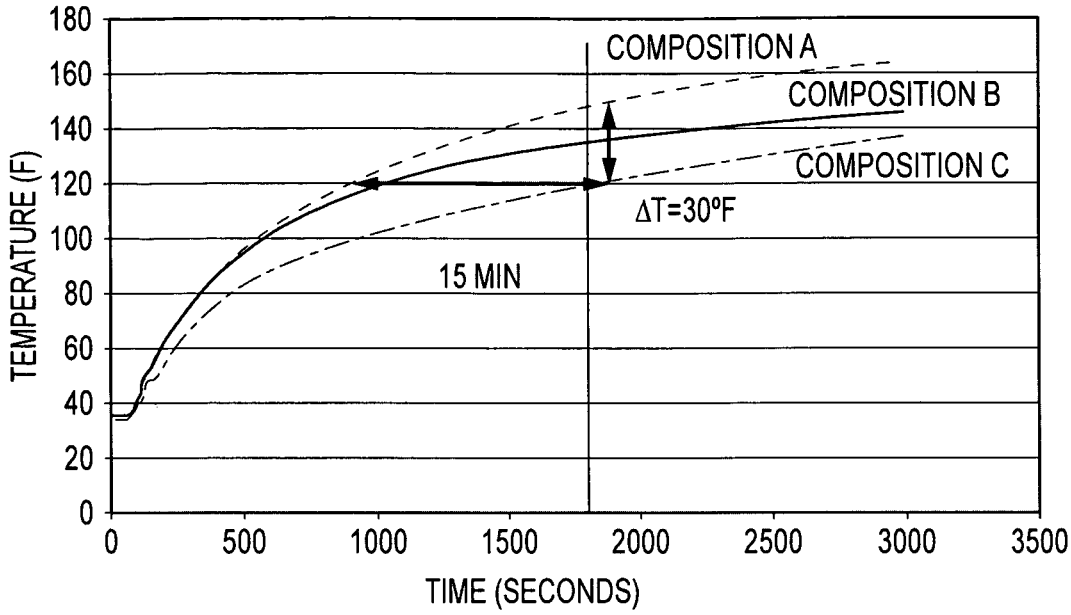
FIG. 11 is a graph showing the temperature rise at a selected time and the time required to achieve a desired temperature when heating a 90-ounce water tray heated using different compositions of active ingredient, catalyst and saline solution combinations in an embodiment of the apparatus according to this disclosure, illustrating the tunable feature of the disclosed apparatus.

For example, FIG. 11 shows the difference in temperature rise for a 90-ounce water tray when heated using three different combinations of Mg—Fe alloy active ingredient, catalyst and amount of saline. The performance is measured in the amount of temperature rise in 30 minutes. Configuration A in the graph of FIG. 11 consisted of 144 g active ingredient alloy, 450 g saline and 1% catalyst. Configuration B consisted of 120 g active ingredient alloy, 330 g saline, and zero catalyst. Configuration C consisted of 105 g active ingredient alloy, 290 g saline and 1% catalyst. The results present in FIG. 11 show that it is possible to controllably modify the desired temperature reached after 30 minutes by as much as 30° F., and also possible to alter the slope of temperature rise, by varying the apportionment of the reacting ingredients.

As a further example illustrative of the invention, FIG. 11 also shows the time required to reach a temperature of 120° F. when heating the 90-ounce water tray. The results show that it is possible to controllably modify when the desired temperature is reached by as much as 15 minutes.

Figure 12:
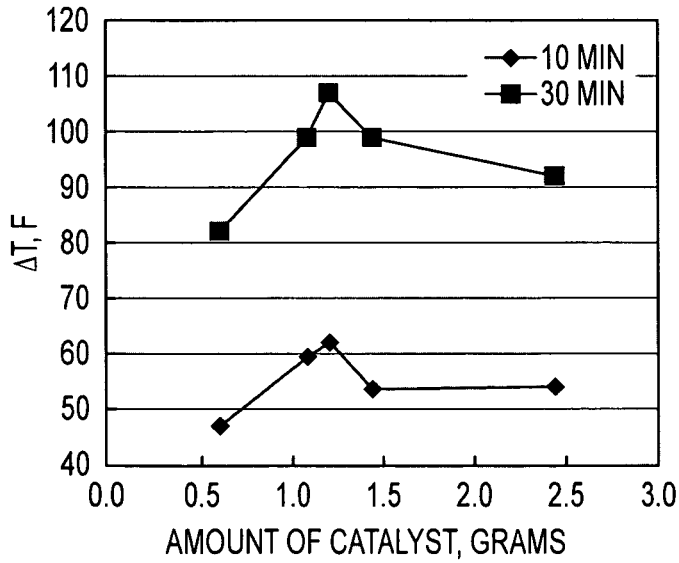
FIG. 12 is a graph showing the temperature increase achieved after 10 minutes and after 30 minutes of heating a 90-ounce test water tray using an embodiment of the disclosed apparatus with varying amounts of catalyst.

As another example, when heating a 90-ounce test water tray, the rate of temperature increase can be controlled by varying the amount of catalyst in the heat-releasing apparatus. FIG. 12 shows a graph of the temperature increase achieved after both 10 minutes and 30 minutes of heating the test tray for varying amount of catalyst. As seen in this graph, after 10 minutes of heating, a temperature increase (ΔT) of 47° F. can be achieved when using an apparatus containing 0.5 gram of catalyst powder, whereas a ΔT of 62° F. can be achieved with an apparatus containing 1.2 gram of catalyst powder. After 30 minutes of heating, an apparatus with 0.5 gram of catalyst powder results in a ΔT of 82° F., whereas an apparatus with 1.2 gram of catalyst powder can provide a ΔT of 107° F.

Thus, as shown in above examples, the flexible design of the disclosed heat-releasing apparatus allows for fine-tuning the performance of the apparatus by varying the amount of ingredients in the apparatus. Also the apparatus may be fine tuned by appropriately designing the placement and shape of pockets in a pouch and/or configuration of pouches in a multi-pouch design. This fine-tuning may be formulated and implemented at the time of manufacture. Applying known thermo chemical principles and calculations and simple experiments, the type, amount, and relative ratios of active ingredient alloy, catalyst, and activator to be apportioned and deposited in respective pockets of an apparatus pouch permitting the function to be predictably customized to the intended use of the apparatus after manufacture.

A method for practicing the invention is evident from the foregoing. However, it is again observed that one aspect of the methodology is to permit a flowing solution to transport soluble ingredients between and amongst the various pockets of the pouch(es) of the apparatus. Once the pouch is wetted, either with a saline or a non-saline solution as described hereinabove, the ingredients such as salt activator and catalyst and/or surfactant, for example, freely mix in the solution and flow through the permeable pockets to contact the generally water-insoluble active ingredient to trigger the desired chemical reaction. The need to rupture any seams or barriers within the main pouch(es) is eliminated.

Thus, summarily described, one preferred method disclosed hereby features basic steps of providing a pouch; defining at least two water-permeable pockets in the pouch; disposing in at least one water-permeable pocket a dry powder active ingredient; disposing in at least one different water-permeable pocket (i.e., physically segregated from the active ingredient) a dry powder catalyst; and supplying the pouch with a salt activator; and then, at the time of use, wetting the pouch with water sufficient to penetrate the water-permeable pockets, causing a substantial portion of the salt activator and the catalyst to dissolve into solution, and permitting the resulting solution to move amongst the water-permeable pockets and come into contact with the active ingredient to initiate an exothermic reaction in the pouch. The step of supplying the pouch with a salt activator can be: a) disposing dry powder salt in a water-permeable pocket defined in the pouch; or b) placing dry powder salt upon the pouch immediately prior to use; or c) a different sub-process in which the steps of supplying the pouch with a salt activator and wetting the pouch with water are combined into to a step of applying saline solution to the pouch.

The method preferably features the added step of disposing in at least one water-permeable pocket at least one other ingredient selected from the group consisting of a dry powder surfactant, a dry powder hydrogen getter, and an inert material. Alternatively, user may incorporate, in a separate solution, at least one ingredient selected from the group consisting of a surfactant, a catalyst, and a salt activator; in such a process, the step of wetting the pouch involves wetting the pouch with this separate solution.

Preferably, the invention permits selectively tuning the rate of the exothermic reaction by selectively measuring the disposition of a powder active ingredient in at least one pocket, and selectively measuring the disposition in the other pockets of at least one other ingredient selected from the group consisting of dry powder salt and dry powder catalyst, wherein the measuring steps occur prior to a step of sealing closed the pockets. Thus, by disposing predetermined, quantified amounts of ingredients into selected pockets at the time of apparatus manufacture, the performance characteristics of the apparatus are pre-determined or "tuned" according to the method to suit the circumstance of use.

In the most preferred practice of the method, the step of disposing a magnesium-iron alloy means disposing a magnesium-iron alloy containing approximately 5 weight percent of iron. Also according to one version of the method, a hydrogen getter and/or an inert material may be incorporated into the magnesium-iron alloy. A hydrogen-getter or inert material, while often incorporated into the alloy, in alternative processes may be disposed into practically any pocket.

In an alternative version of the present method, the step of defining at least two water-permeable pockets in the pouch may involve defining at least three pockets, in which instance the method may further comprise the steps of disposing the powder active ingredient in at least one pocket, and disposing in at least one of the other pockets in the pouch, besides the pockets in which active ingredient is disposed, at least one other ingredient selected from the group consisting of the catalyst, a powder salt activator, and a powder surfactant. In this version of the method, at least one of the other pockets holds a powder salt activator, and the step of wetting the pouch is applying non-saline water to the pouch. Alternatively, none of the pockets holds a powder salt activator, in which case the step of supplying the pouch with a salt activator may mean placing dry powder salt upon the pouch immediately prior to use. If none of the pockets holds a powder salt activator, in yet another alternative method the step of supplying the pouch with a salt activator and the step of wetting the pouch are the combined step of applying a saline solution to the pouch. The step of disposing in the other pockets in the pouch at least one other ingredient preferably involves disposing a powder mixture of at least two of the other ingredients. Optionally, this method also optionally may include the added alternative step of incorporating in a separate solution at least one ingredient selected from the group consisting of a surfactant, a catalyst, and a salt activator, so that the step of wetting the pouch comprises simply wetting the pouch with that separate solution.

The method optionally may involve a more sophisticated process in which the step of providing a pouch comprises providing two or more pouches connected together, and in which the step of defining at least two water-permeable pockets comprises defining at least one water-permeable pocket in each of these pouches. This method of using more than one pouch has the added steps of disposing an active ingredient in at least one pocket, and disposing in selected other pockets (i.e., besides the pockets in which active ingredient is disposed) one or more ingredients selected from the group consisting of a catalyst, a salt activator, and a surfactant. This version of the method likewise to previously described versions may include the step of disposing in any pocket a hydrogen getter or an inert ingredient. And, similar to previously summarized versions, if at least one of the pockets holds a powder salt activator, the step of wetting the pouch preferably is simply applying non-saline water to the pouch. If none of the pockets holds a powder salt activator, the step of supplying the pouch with a salt activator may feature: a) placing dry powder salt activator upon the pouch immediately prior to use; or b) applying a saline solution to the pouch, which not only supplies the salt activator but also wets the pouch. The step of disposing in the other pockets in the pouch at least one other ingredient preferably means disposing a powder mixture of at least two of the other ingredients.

In all embodiments of the method, the step of defining at least two water-permeable pockets in the pouch means creating non-frangible seams in the pouch.

The heat-releasing apparatus and method according to this disclosure offer an additional significant advantage. In general, conventional flameless ration heaters have all or a majority of ingredients blended together—this can result in limited shelf-life of the apparatus. In known devices and methods, the ingredients (such as an active ingredient Mg—Fe alloy and a catalyst)—which are in intimate contact with each other in the mixed state—can react with certain other ingredients in the blend. Over time, this can result in degradation of the performance of the flameless heater. As an example, certain flameless ration heaters which contain certain catalysts, have been demonstrated to show a decreased rate of temperature rise after about two years of shelf life.

In contrast, in this disclosed invention, the ingredients are mainly enclosed in separate pockets and are not in intimate contact with each other. As a result of this physical segregation, there is limited opportunity for the ingredients to react with one another during pre-use storage. Thus, the disclosed heat-releasing apparatus can offer an added advantage of a significantly longer shelf-life.

Although the invention has been described in detail with particular reference to these preferred embodiments, other embodiments can achieve the same results. The present invention can be practiced by employing conventional materials, methodology and equipment. Accordingly, the details of such materials, equipment and methodology are not set forth herein in detail. In the previous description, specific details are set forth, such as specific materials, structures, chemicals, processes, etc., in order to provide a thorough understanding of the present invention. However, as one having ordinary skill in the art would recognize, the present invention can be practiced without resorting to the details specifically set forth. In other instances, well known processing structures have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover in the appended claims all such modifications and equivalents.

What is claimed is:

1. A method for flamelessly heating an item comprising the steps of:

providing a pouch;

defining at least two water-permeable pockets in the pouch;

disposing in at least one water-permeable pocket a dry powder active ingredient;

disposing in at least one different water-permeable pocket, physically segregated from the active ingredient, a dry powder catalyst;

supplying the pouch with a salt activator;

at time of use, wetting the pouch with water sufficient to penetrate the water-permeable pockets, causing a substantial portion of the salt activator and the catalyst to dissolve into solution; and permitting the resulting solution to move amongst the water-permeable pockets and come into contact with the active ingredient to initiate an exothermic reaction in the pouch.

2. The method of claim 1 wherein the step of supplying the pouch with a salt activator comprises disposing dry powder salt in a water-permeable pocket defined in the pouch.

3. The method of claim 1 wherein the step of supplying the pouch with a salt activator comprises placing dry powder salt upon the pouch immediately prior to use.

4. The method of claim 1 wherein the steps of supplying the pouch with a salt activator and wetting the pouch with water comprise the combined step of applying saline solution to the pouch.

5. The method of claim 1 further comprising the step of disposing in at least one water-permeable pocket at least one other ingredient selected from the group consisting of a dry powder surfactant, a dry powder hydrogen getter, and an inert material.

6. The method of claim 1 further comprising the step of incorporating in a separate solution at least one ingredient selected from the group consisting of a surfactant, a catalyst, and a salt activator and wherein the step of wetting the pouch comprises wetting the pouch with the separate solution.

7. The method of claim 1 further comprising the step of selectively tuning the rate of the exothermic reaction by:

selectively measuring the disposition of a powder active ingredient in at least one pocket; and selectively measuring the disposition in the other pockets of at least one other ingredient selected from the group consisting of dry powder salt and dry powder catalyst;

wherein the measuring steps occur prior to a step of sealing closed the pockets.

8. The method of claim 1 wherein the step of disposing the dry powder active ingredient comprises disposing a magnesium-iron alloy containing up to 12 weight percent of iron.

9. The method of claim 8 wherein the step of disposing a magnesium-iron alloy containing up to 12 weight percent of iron comprises disposing a magnesium-iron alloy containing approximately 5 weight percent of iron.

10. The method of claim 8 further comprising the step of incorporating a hydrogen getter into the magnesium-iron alloy.

11. The method of claim 8 further comprising the step of incorporating an inert material into the magnesium-iron alloy.

12. The method of claim 1 wherein the step of defining at least two water-permeable pockets in the pouch comprises defining at least three pockets, and further comprising the steps of:

disposing the powder active ingredient in at least one pocket; and disposing in at least one of the other pockets in the pouch, besides the pockets in which active ingredient is disposed, at least one other ingredient selected from the group consisting of the catalyst, a powder salt activator, and a powder surfactant.

13. The method of claim 12 further comprising the step of disposing in any pocket either a hydrogen getter or an inert material.

14. The method of claim 12 wherein at least one of the other pockets holds a powder salt activator, and the step of wetting the pouch comprises applying non-saline water to the pouch.

15. The method of claim 12 wherein none of the pockets holds a powder salt activator and wherein the step of supplying the pouch with a salt activator comprises placing dry powder salt upon the pouch immediately prior to use.

16. The method of claim 12 wherein none of the pockets holds a powder salt activator and the steps of supplying the pouch with a salt activator and of wetting the pouch comprise the combined step of applying a saline solution to the pouch.

17. The method of claim 12 wherein the step of disposing in the other pockets in the pouch at least one other ingredient comprises disposing a powder mixture of at least two of the other ingredients.

18. The method of claim 12 further comprising the step of incorporating in a separate solution at least one ingredient selected from the group consisting of a surfactant, a catalyst, and a salt activator and wherein the step of wetting the pouch comprises wetting the pouch with the separate solution.

19. The method of claim 12 further comprising the step of selectively tuning the rate of the exothermic reaction by:

selectively measuring the disposition of the powder active ingredient in at least one pocket; and selectively measuring the disposition in the other pockets of at least one other ingredient selected from the group consisting of dry powder salt and dry powder catalyst;

wherein the measuring steps occur prior to a step of sealing closed the pockets.

20. The method of claim 1 wherein:

the step of providing a pouch comprises providing two or more pouches connected together; and the step of defining at least two water-permeable pockets comprises defining at least one water-permeable pocket in each pouch.

21. The method of claim 20 further comprising the steps of:

disposing an active ingredient in at least one pocket;

disposing in selected other pockets, besides the pockets in which active ingredient is disposed, one or more ingredients selected from the group consisting of a catalyst, a salt activator, and a surfactant.

22. The method of claim 21 further comprising the step of disposing in any pocket a hydrogen getter or an inert ingredient.

23. The method of claim 21 wherein at least one of the pockets holds a powder salt activator, and the step of wetting the pouch comprises applying non-saline water to the pouch.

24. The method of claim 21 wherein none of the pockets holds a powder salt activator and wherein the step of supplying the pouch with a salt activator comprises placing dry powder salt activator upon the pouch immediately prior to use.

25. The method of claim 21 wherein none of the pockets holds a powder salt activator and the steps of supplying the pouch with a salt activator and of wetting the pouch comprise the combined step of applying a saline solution to the pouch.

26. The method of claim 21 wherein the step of disposing in the other pockets in the pouch at least one other ingredient comprises disposing a powder mixture of at least two of the other ingredients.

27. The method of claim 21 further comprising the step of incorporating in a separate solution at least one ingredient selected from the group consisting of a surfactant, a catalyst, and a salt activator and wherein the step of wetting the pouch comprises wetting the pouch with the separate solution.

28. The method of claim 21 further comprising the step of selectively tuning the rate of the exothermic reaction by:

selectively measuring the disposition of the active ingredient in at least one pocket; and selectively measuring the disposition in the other pockets of mixtures of one or more of the other ingredients selected from the group consisting of dry powder salt and dry powder catalyst;

wherein the measuring steps occur prior to a step of sealing closed the pockets.

29. The method of claim 1 wherein the step of defining at least two water-permeable pockets in the pouch comprises creating non-frangible seams in the pouch.

30. A method for flamelessly heating an item comprising the steps of:

providing a pouch;

defining with non-frangible seams a plurality of water-permeable pockets in the pouch;

disposing in at least one water-permeable pocket a dry powder active ingredient;

disposing in at least one water-permeable pocket, physically segregated from the active ingredient, a dry powder catalyst;

supplying the pouch with a salt activator;

at time of use, wetting the pouch with water sufficient to penetrate the water-permeable pockets, causing a substantial portion of the salt activator and the catalyst to dissolve into solution; and permitting the resulting solution to move amongst the water-permeable pockets and come into contact with the active ingredient to initiate an exothermic reaction in the pouch.

31. The method of claim 30 wherein the step of supplying the pouch with a salt activator comprises disposing dry salt activator powder in a water-permeable pocket defined in the pouch.

32. The method of claim 30 wherein the step of supplying the pouch with a salt activator comprises placing dry powder salt upon the pouch immediately prior to use.

33. The method of claim 30 wherein the steps of supplying the pouch with a salt activator and wetting the pouch with water comprise the combined step of applying saline solution to the pouch.

34. The method of claim 30 further comprising the step of disposing in at least one water-permeable pocket at least one other ingredient selected from the group consisting of a dry powder surfactant, a dry powder hydrogen getter, and an inert material.

35. The method of claim 30 further comprising the step of incorporating in a separate solution at least one ingredient selected from the group consisting of a surfactant, a catalyst, and a salt activator and wherein the step of wetting the pouch comprises wetting the pouch with the separate solution.

36. The method of claim 30 further comprising the step of selectively tuning the rate of the exothermic reaction by:

selectively measuring the disposition of the powder active ingredient in at least one pocket; and selectively measuring the disposition in other pockets of at least one other ingredient selected from the group consisting of dry powder salt and dry powder catalyst;

wherein the measuring steps occur prior to a step of sealing closed the pockets.

37. The method of claim 30 wherein the step of disposing the dry powder active ingredient comprises disposing a magnesium-iron alloy containing up to 12 weight percent of iron.

38. The method of claim 37 wherein the step of disposing a magnesium-iron alloy containing up to 12 weight percent of iron comprises disposing a magnesium-iron alloy containing approximately 5 weight percent of iron.

39. The method of claim 37 further comprising the step of incorporating a hydrogen getter into the magnesium-iron alloy.

40. The method of claim 37 further comprising the step of incorporating an inert material into the magnesium-iron alloy.

41. The method of claim 30 wherein:

the step of providing a pouch comprises providing two or more pouches connected together; and the step of defining at least two water-permeable pockets comprises defining at least one water-permeable pocket in each pouch.

42. The method of claim 41 further comprising the steps of:

disposing active ingredient in at least one pocket;

disposing in selected pockets, besides the pockets in which active ingredient is disposed, one or more other ingredients selected from the group consisting of a catalyst, a salt activator, and a surfactant.

43. The method of claim 42 further comprising the step of disposing in any pocket a hydrogen getter or an inert ingredient.

44. The method of claim 42 wherein at least one of the pockets holds a powder salt activator, and the step of wetting the pouch comprises applying non-saline water to the pouch.

45. The method of claim 42 wherein none of the pockets holds a powder salt activator and wherein the step of supplying the pouch with a salt activator comprises placing dry powder salt activator upon the pouch immediately prior to use.

46. The method of claim 42 wherein none of the pockets holds a powder salt activator and the steps of supplying the pouch with a salt activator and of wetting the pouch comprise the combined step of applying a saline solution to the pouch.

47. The method of claim 42 wherein the step of disposing in the other pockets in the pouch at least one other ingredient comprises disposing a powder mixture of at least two of the other ingredients.

48. The method of claim 42 further comprising the step of incorporating in a separate solution at least one ingredient selected from the group consisting of a surfactant, a catalyst, and a salt activator and wherein the step of wetting the pouch comprises wetting the pouch with the separate solution.

49. The method of claim 42 further comprising the step of selectively tuning the rate of the exothermic reaction by:

selectively measuring the disposition of the powder active ingredient in at least one pocket; and selectively measuring the disposition in the other pockets of at least one of the other ingredient selected from the group consisting of dry powder salt and dry powder catalyst;

wherein the measuring steps occur prior to a step of sealing closed the pockets.

50. An apparatus for flamelessly heating an item, the apparatus comprising:

one pouch;

at least two water-permeable pockets in the pouch;

a dry powder active ingredient disposed in at least one water-permeable pocket;

a dry powder catalyst disposed in at least one different water-permeable pocket, physically segregated from the active ingredient;

a salt activator;

wherein the pouch is wetted at the time of use with water sufficient to penetrate the water-permeable pockets, causing a substantial portion of the salt activator and the catalyst to dissolve into solution; and wherein the resulting solution is allowed to move amongst the water-permeable pockets and come into contact with the active ingredient to initiate an exothermic reaction in the pouch.

51. An apparatus according to claim 50 wherein the salt activator comprises dry powder salt activator disposed in at least one water-permeable pocket defined in the pouch.

52. An apparatus according to claim 50 wherein the salt activator comprises a dry powder salt disposed upon the pouch exterior immediately prior to use.

53. An apparatus according to claim 50 wherein the salt activator comprises a saline solution applied to the pouch exterior immediately prior to use.

54. An apparatus according to claim 50 further comprising at least one other ingredient, selected from the group consisting of a dry powder surfactant, a dry powder hydrogen getter, and an inert material, disposed in at least one other water-permeable pocket.

55. An apparatus according to claim 50 further comprising a separate container which contains a separate solution with at least one ingredient selected from the group consisting of a surfactant, a catalyst, and a salt activator; wherein the separate solution in the separate container wets the pouch at time of use.

56. An apparatus according to claim 50 comprising:

a selectively measured quantity of powder active ingredient sealed in at least one pocket; and a selectively measured quantity of at least one other ingredient selected from the group consisting of dry powder salt and dry powder catalyst; and sealed into another pocket;

whereby the rate of the exothermic reaction is selectively fine tuned.

57. An apparatus according to claim 50 wherein the active ingredient comprises a magnesium-iron alloy containing up to 12 weight percent of iron.

58. An apparatus according to claim 57 wherein the magnesium-iron alloy contains approximately 5 weight percent of iron.

59. An apparatus according to claim 57 further comprising a hydrogen getter incorporated into the magnesium-iron alloy.

60. An apparatus according to claim 57 further comprising an inert material incorporated into the magnesium-iron alloy.

61. An apparatus according to claim 50 wherein the at least two water-permeable pockets in the pouch comprise at least three pockets, and further comprising:

the powder active ingredient disposed in at least one pocket; and at least one other ingredient selected from the group consisting of a catalyst, a powder salt activator, and a powder surfactant disposed in at least one other pocket in the pouch, besides the pocket in which the active ingredient is disposed.

62. An apparatus according to claim 61 further comprising a hydrogen getter or an inert material disposed in any pocket.

63. An apparatus according to claim 61 wherein the salt activator comprises dry salt activator powder disposed in at least one water-permeable pocket defined in the pouch.

64. An apparatus according to claim 61 wherein none of the pockets holds a powder salt activator and the salt activator comprises dry powder salt placed upon the pouch immediately prior to use.

65. An apparatus according to claim 61 wherein none of the pockets holds a powder salt activator and the salt activator comprises a saline solution applied to the pouch immediately prior to use.

66. An apparatus according to claim 61 wherein the at least one other ingredient comprises a powder mixture of at least two of the other ingredients.

67. An apparatus according to claim 61 further comprising a separate container which contains a separate solution with at least one ingredient selected from the group consisting of a surfactant, a catalyst, and a salt activator; wherein the separate solution in the separate container wets the pouch at time of use.

68. An apparatus according to claim 61 further comprising:

a selectively measured quantity of powder active ingredient sealed in at least one pocket; and a selectively measured quantity of at least one other ingredient selected from the group consisting of dry powder salt and dry powder catalyst; and sealed into another pocket;

whereby the rate of the exothermic reaction is selectively fine tuned.

69. An apparatus according to claim 50 comprising:

at least two pouches connected together; and at least one water-permeable pocket in each pouch.

70. An apparatus according to claim 69 further comprising:

an active ingredient disposed in at least one pocket; and one or more ingredients from the group consisting of a catalyst, a salt activator, and a surfactant disposed in at least one other pocket, besides the pocket with the active ingredient.

71. An apparatus according to claim 70 further comprising a pocket containing at least one ingredient selected from the group consisting of an inert material and a hydrogen getter.

72. An apparatus according to claim 70 wherein the salt activator comprises dry salt activator powder disposed in at least one water-permeable pocket defined in the pouch.

73. An apparatus according to claim 70 wherein the salt activator comprises a dry powder salt disposed upon the pouch exterior immediately prior to use.

74. An apparatus according to claim 70 wherein the salt activator comprises a saline solution applied to the pouch exterior immediately prior to use.

75. An apparatus according to claim 70 further comprising at least one other ingredient selected from the group consisting of a dry powder surfactant, a dry powder hydrogen getter, and an inert material, disposed in at least one other water-permeable pocket.

76. An apparatus according to claim 70 further comprising a separate container which contains a separate solution with at least one ingredient selected from the group consisting of a surfactant, a catalyst, and a salt activator; wherein the separate solution in the separate container wets the pouch at time of use.

77. An apparatus according to claim 70 wherein the rate of the exothermic reaction is selectively fine tuned by:

incorporating a measured quantity of powder active ingredient sealed in at least one pocket; and incorporating a measured quantity of at least one other ingredient sealed into another pocket.

78. An apparatus according to claim 50 wherein the at least two water-permeable pockets in the pouch are defined by non-frangible seams in the pouch.

* * * * *